US010226954B2

(12) United States Patent
Kitazawa et al.

(10) Patent No.: US 10,226,954 B2
(45) Date of Patent: Mar. 12, 2019

(54) INK JET APPARATUS

(71) Applicant: SEIKO EPSON CORPORATION, Tokyo (JP)

(72) Inventors: Koji Kitazawa, Nagano (JP); Toshio Kumagai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/712,602

(22) Filed: Sep. 22, 2017

(65) Prior Publication Data

US 2018/0009248 A1 Jan. 11, 2018

Related U.S. Application Data

(62) Division of application No. 15/079,242, filed on Mar. 24, 2016, now Pat. No. 9,796,199.

(30) Foreign Application Priority Data

Apr. 9, 2015 (JP) ..... 2015-079824

(51) Int. Cl.
*B41J 29/377* (2006.01)

(52) U.S. Cl.
CPC ..... *B41J 29/377* (2013.01); *B41J 2202/08* (2013.01)

(58) Field of Classification Search
CPC ..... B41J 29/377; B41J 2202/08; B41J 2/175; B41J 2/1408
USPC ..... 347/9, 14, 17, 18, 34, 223
See application file for complete search history.

(56) References Cited

U.S. PATENT DOCUMENTS

2009/0267985 A1 10/2009 Usui
2013/0215203 A1 8/2013 Chen
2014/0028768 A1 1/2014 Chen

FOREIGN PATENT DOCUMENTS

JP 2004-058632 A 2/2004
JP 2009-220499 A 10/2009

*Primary Examiner* — Jannelle M Lebron

(57) ABSTRACT

An ink jet apparatus includes a head, a circuit substrate, a cover frame, a heat sink, a fan, and a wall section. The cover frame supports the circuit substrate that has a drive circuit that drives the head inside of the cover frame and has a through hole. The heat sink that dissipates heat generated in the circuit substrate is disposed inside of the cover frame and has a part that is in direct or indirect contact with the circuit substrate. The fan generates air flow and is arranged such that the fan and the heat sink face to each other via the through hole. The wall section is disposed inside of the cover frame such that the air flow is not directly blown against the drive circuit and the air flow having changed a direction after blown against the heat sink is not blown against the drive circuit.

8 Claims, 6 Drawing Sheets

INK JET APPARATUS

CROSS-REFERENCE TO RELATED APPLICATIONS

This application is a divisional application of U.S. patent application Ser. No. 15/079,242 filed on Mar. 24, 2016. This application claims priority to Japanese Patent Application No. 2015-079824 filed on Apr. 9, 2015. The entire disclosures of U.S. patent application Ser. No. 15/079,242 and Japanese Patent Application No. 2015-079824 are expressly incorporated herein by reference.

BACKGROUND

1. Technical Field

The present invention relates to an ink jet apparatus.

2. Related Art

In the related art, there is known a liquid discharge apparatus including a discharge head that discharges liquid onto a recording medium, a control substrate connected to the discharge head, an air flow generator that generates air flow for cooling the control substrate, and the like (see, for example, JP-A-2009-220499).

In the above apparatus, however, when the air flow for cooling the control substrate contains mist, the mist adheres to the surface of the control substrate and causes the occurrence of an electrical failure, such as a short circuit, which is problematic.

SUMMARY

The invention can be achieved as the following embodiment or application examples.

According to one aspect of the invention, an ink jet apparatus includes a head, a circuit substrate, a cover frame, a heat sink, a fan, and a wall section. The head is configured to discharge liquid. The circuit substrate has a drive circuit that is configured to drive the head. The cover frame supports the circuit substrate inside of the cover frame, and has a through hole. The heat sink has a part that is in direct or indirect contact with the circuit substrate and is configured to dissipate heat generated in the circuit substrate, the heat sink being disposed inside of the cover frame. The fan is configured to generate air flow to cool the heat sink, and is arranged such that the fan and the heat sink face to each other via the through hole. The wall section is disposed inside of the cover frame such that the air flow is not directly blown against the drive circuit and such that the air flow having changed a direction after blown against the heat sink is not blown against the drive circuit.

According to the aspect of the invention, the wall section has one end portion that contacts the heat sink and an opposite end portion that contacts the cover frame, and the opposite end portion is opposite the one end portion.

According to the aspect of the invention, the fan is disposed to face the drive circuit and the heat sink is disposed between the drive circuit and the fan.

According to the aspect of the invention, the ink jet apparatus further includes a collection section configured to collect mist adhered to the heat sink.

According to the aspect of the invention, the collection section is attached to the cover frame such that the collection section does not overlap the heat sink as viewed in a direction in which the fan and the heat sink face to each other.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention is described with reference to the drawings. In the following drawings, each member and the like are illustrated in a scale different from actual scale so that each of the members and the like is recognizable.

First, a configuration of the ink jet apparatus is described. An ink jet apparatus according to the embodiment includes a head, a circuit substrate, a heat sink, and a fan. The head discharges liquid. The circuit substrate has a drive circuit for driving the head. Part of the heat sink is directly or indirectly in contact with the circuit substrate, and the heat sink can dissipate heat generated in the circuit substrate. The fan generates air flow capable of cooling the heat sink. The heat sink is configured such that the air flow is not directly blown against the drive circuit and such that the air flow having changed a direction after blown against the heat sink is not blown against the drive circuit. Hereinafter, the configuration of the ink jet apparatus is specifically described.

Figure 1:
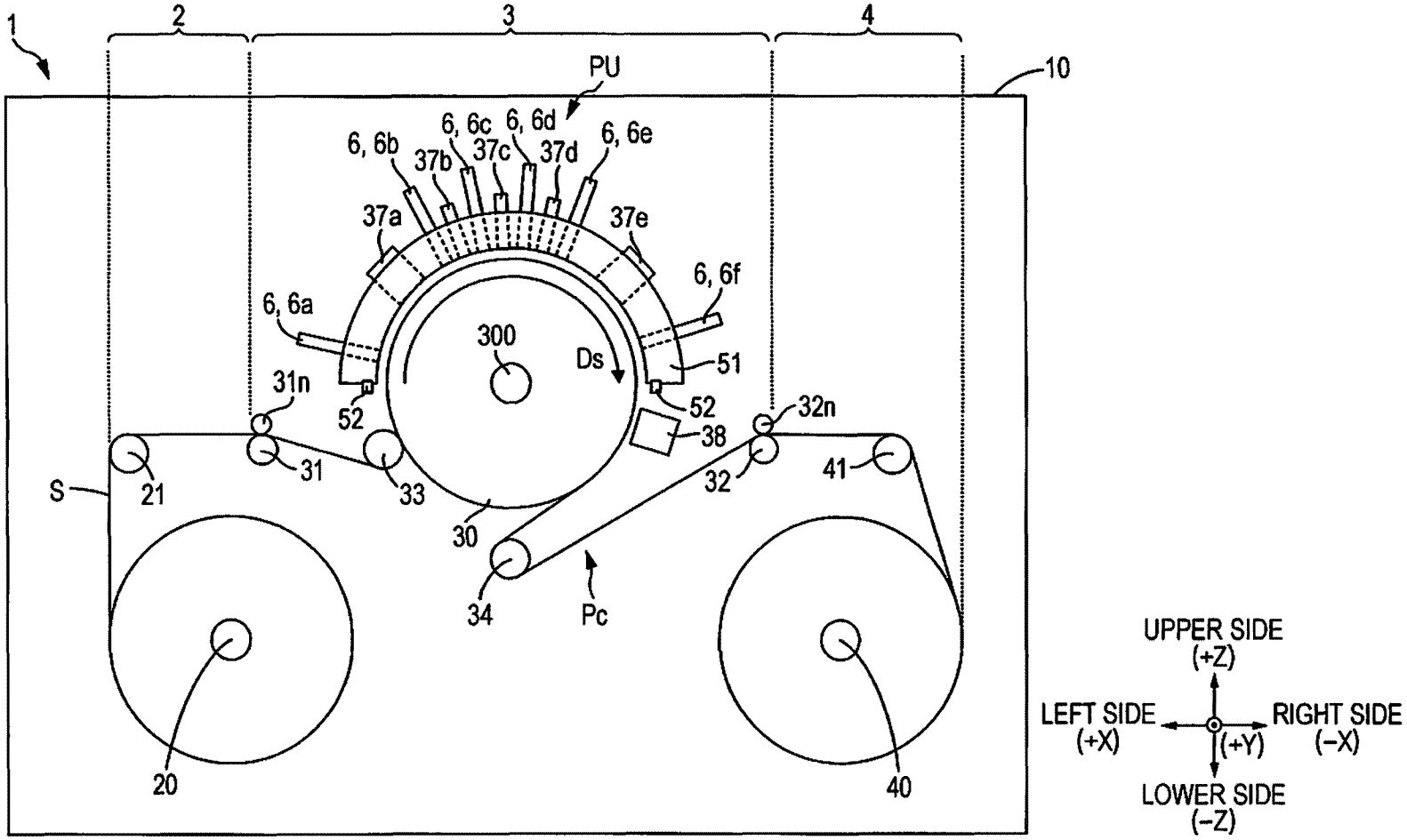
FIG. 1 is a schematic view illustrating a configuration of an ink jet apparatus.
Figure 2:
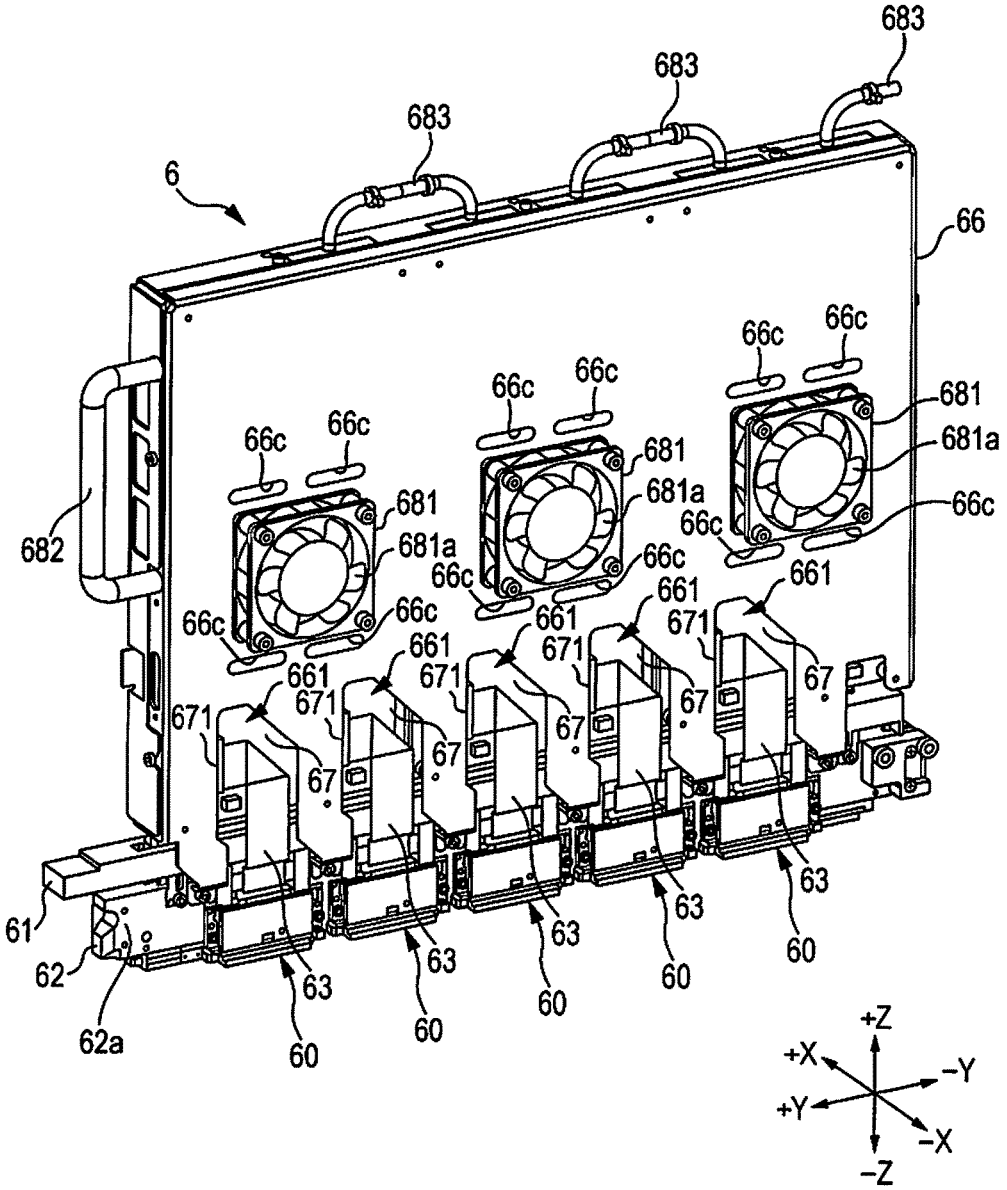
FIG. 2 is a schematic view illustrating a configuration of a head unit.

FIG. 1 is a schematic view illustrating the configuration of the ink jet apparatus. In FIG. 1, an X-Y-Z rectangular coordinate system that represents a right/left direction X, a front/rear direction Y, and a vertical direction Z is indicated to clearly show positional relations between the sections of the apparatus as necessary. FIG. 2 is a schematic view (perspective view) illustrating a configuration of a head unit.

As illustrated in FIG. 1, an ink jet apparatus 1 includes a feed shaft 20 and a take-up shaft 40, and a sheet S (web), which is wound around the feed shaft 20 and the take-up shaft 40 in a roll, is tightly placed along a transportation path Pc. An image is recorded on the sheet S while the sheet S is transported in a transporting direction Ds from the feed shaft 20 toward the take-up shaft 40. The sheet S may be paper or film. Specific examples of the paper include high-quality paper, cast coated paper, art paper, and coated paper. Specific examples of the film include synthetic paper, PET (polyethylene terephthalate), and PP (polypropylene). Schematically, the ink jet apparatus 1 includes a feed section 2 (feed area) where the sheet S is fed from the feed shaft 20, a process section 3 (process area) where an image is recorded onto the sheet S fed from the feed section 2, and a take-up section 4 (take-up area) where the sheet S having the image recorded in the process section 3 is taken up around the take-up shaft 40. These functional sections 2, 3, and 4 aligned in the X direction are housed in a housing 10. In the following description, the surface of the sheet S onto which an image is recorded is referred to as the front surface, while the surface on the opposite side of the sheet S is referred to as the back surface.

The feed section 2 has the feed shaft 20 around which the end of the sheet S is wound and a driven roller 21 on which the sheet S discharged from the feed shaft 20 is wound. The end of the sheet S is wound around the feed shaft 20 and supported in a state in which the front surface of the sheet S faces outward. The feed shaft 20 then rotates in a clockwise direction on the paper surface of FIG. 1, and thereby, the sheet S wound around the feed shaft 20 is fed to the process section 3 via the driven roller 21. The sheet S is wound around the feed shaft 20 with a core tube (not shown) that is detachable from the feed shaft 20 in between. Accordingly, when the sheet S of the feed shaft 20 is used up, a new core tube around which the rolled sheet S is wound is mounted on the feed shaft 20 to replace the sheet S of the feed shaft 20.

In the process section 3, while supporting the sheet S fed from the feed section 2 on the rotary drum 30, a process unit PU disposed around the outer circumference surface of a rotary drum 30 performs processing as appropriate to print (record) an image onto the sheet S. In the process section 3, a front drive roller 31 and a rear drive roller 32 are provided on both sides of the rotary drum 30 in the X direction. An image is printed in a state in which the sheet S being transported from the front drive roller 31 to the rear drive roller 32 is supported on the rotary drum 30.

The front drive roller 31 has a plurality of very small projections, formed by thermal spraying, on the outer circumference surface thereof. The back surface of the sheet S fed from the feed section 2 is wound onto the front drive roller 31. The front drive roller 31 then rotates in the clockwise direction on the paper surface of FIG. 1 to transport the sheet S, fed from the feed section 2, to the downstream side of the transportation path. In addition, the front drive roller 31 is provided with a nip roller 31*n*. The nip roller 31*n* in the state of being biased to the front drive roller 31 abuts the front surface of the sheet S. The sheet S is pinched between the nip roller 31*n* and the front drive roller 31. Accordingly, a frictional force is ensured between the front drive roller 31 and the sheet S, thus allowing the sheet S to be reliably transported by the front drive roller 31.

The rotary drum 30 is a cylindrical drum having a center line extending in the Y direction. The sheet S can be wound onto the outer circumference surface of the rotary drum 30. Further, the rotary drum 30 has a rotary shaft 300 extending in the axial direction through the center line of the cylindrical shape. The rotary shaft 300 is rotatably supported by a support mechanism, not shown. The rotary drum 30 is configured so as to rotate around the rotary shaft 300.

The sheet S transported from the front drive roller 31 to the rear drive roller 32 is wound onto the outer circumference surface of the rotary drum 30 as described above so that the back surface of the sheet S faces the outer circumference surface of the rotary drum 30. The rotary drum 30 supports the sheet S from the back surface side, while receiving a frictional force that is generated between the rotary drum 30 and the sheet S and rotating forward in the transporting direction Ds of the sheet S. In the process section 3, driven rollers 33 and 34 for folding back the sheet S are provided on the upstream side and the downstream side of the rotary drum 30 where the sheet S is wound onto. The front surface of the sheet S is wound around the driven roller 33 so that the sheet S is folded back between the front drive roller 31 and the rotary drum 30. Meanwhile, the front surface of the sheet S is wound around the driven roller 34 so that the sheet S is folded back between the rotary drum 30 and the rear drive roller 32. In this manner, the sheet S is folded back on the upstream side and the downstream side in the transporting direction Ds with respect to the rotary drum 30, thereby ensuring the portion of the sheet S which is wound onto the rotary drum 30 (an area that supports the sheet S) to be long.

The rear drive roller 32 has a plurality of very small projections, formed by thermal spraying, on the outer circumference surface thereof. The sheet S transported from the rotary drum 30 via the driven roller 34 is wound onto the rear drive roller 32 so that the back surface side of the sheet S faces the outer circumference surface of the rear drive roller 32. The rear drive roller 32 then rotates in the clockwise direction on the paper surface of FIG. 1 to transport the sheet S to the take-up section 4. In addition, the rear drive roller 32 is provided with a nip roller 32*n*. The nip roller 32*n* in the state of being biased to the rear drive roller 32 abuts the front surface of the sheet S. The sheet S is pinched between the nip roller 32*n* and the rear drive roller 32. Accordingly, a frictional force is ensured between the rear drive roller 32 and the sheet S, thus allowing the sheet S to be reliably transported by the rear drive roller 32.

In the manner as described above, the sheet S transported from the front drive roller 31 to the rear drive roller 32 is supported on the outer circumference surface of the rotary drum 30. Further, the process section 3 is provided with the process unit PU so as to print an image onto the front surface of the sheet S supported on the rotary drum 30. The process unit PU includes head units 6 (6*a* to 6*f*) and UV radiators 37*a* to 37*e*. Moreover, the process unit PU includes a carriage 51, and the carriage 51 supports the head units 6*a* to 6*f* and the UV radiators 37*a* to 37*e*.

The six head units 6*a* to 6*f* are aligned in the transporting direction Ds. The head units 6*a* to 6*f* correspond to white, yellow, cyan, magenta, black, and clear (transparent) in this order and can discharge inks of the corresponding colors from nozzles by employing an ink jet method. Each of the head units 6*a* to 6*f* includes a head 60 (see FIG. 2) that discharges ink as a liquid in the form of droplets and a plurality of nozzles aligned in the Y direction in the heads 60. The head 60 is configured to receive ink from an ink supply section (not shown) and can discharge the supplied ink from the nozzle. These six head units 6*a* to 6*f* are radially disposed with respect to the rotary shaft 300 of the rotary drum 30 and are aligned around the outer circumference surface of the rotary drum 30. The head units 6*a* to 6*f* are positioned with respect to the rotary drum 30 by the carriage 51 and face the rotary drum 30 so as to have a slight clearance (paper gap) between the rotary drum 30 and the head units 6*a* to 6*f*. Accordingly, the head units 6*a* to 6*f* face the front surface of the sheet S wound onto the rotary drum 30 so as to have a predetermined paper gap between the front surface of the sheet S and the head units 6*a* to 6*f*. In a state in which the paper gap is regulated by the carriage 51 in this manner, each of the head units 6*a* to 6*f* discharges ink, and the ink is thereby discharged onto a desired position on the front surface of the sheet S to form (record) a color image on the front surface of the sheet S.

The head unit 6*a* that discharges a white ink is used for forming a white background on a transparent sheet S when an image is to be printed on the transparent sheet S. Specifically, the head unit 6*a* forms a background by discharging the white ink so as to cover the entire surface of the area that is a target area for image formation. Then, the head units 6*b* to 6*e* that respectively discharge yellow, cyan, magenta, and black inks form a color image on the white background. Further, the head unit 6*f* discharges a clear ink on the color image to cover the color image with the clear ink. This can provide the color image with a texture such as a glossy texture or a matte texture.

As the ink for use in each of the head units 6*a* to 6*f*, a UV (ultraviolet) ink (photo-curable ink) that is cured by being irradiated with ultraviolet rays (light) is used. In order for the ink to be cured and fixed to the sheet S, the UV radiators 37*a* to 37*e* are provided. This ink-curing includes main curing and temporary curing which are selectively used. Herein, the main curing is the process of curing ink to such a degree as to stop wetting and spreading of the ink by irradiating the ink with ultraviolet rays having a relatively strong radiation intensity. The temporary curing is the process of curing ink to such a degree as to make wetting and spreading of the ink sufficiently slow as compared with the case of not irradiating the ink with ultraviolet rays, and is not intended to perform the main curing of the ink.

Specifically, the UV radiator 37*a* for main curing is disposed between the white head unit 6*a* and the cyan head unit 6*b*. Thus, the white background formed by the head unit 6*a* receives ultraviolet rays from the UV radiator 37*a*, to be subjected to the main curing, before inks from the head units 6*b* to 6*f* are overlaid. The UV radiators 37*b* to 37*d* for temporary curing are respectively disposed between the yellow, cyan, magenta, and black head units 6*b* to 6*e*. Thus, the inks discharged from the respective head units 6*b* to 6*d* receive ultraviolet rays from the UV radiators 37*b* to 37*d*, to be subjected to the temporary curing, before inks from the head units 6*c* to 6*e* on the downstream side in the transporting direction Ds are overlaid. This suppresses the occurrence of colors mixing, such as mixing of inks discharged from the respective head units 6*b* to 6*e*. The UV radiator 37*e* for main curing is disposed between the black head unit 6*e* and the clear head unit 6*f*. Thus, the color image formed by the head units 6*b* to 6*e* receive ultraviolet rays from the UV radiator 37*e*, to be subjected to the main curing, before an ink from the head unit 6*f* is overlaid.

Further, as described above, the six head units 6*a* to 6*f* and the five UV radiators 37*a* to 37*e* are mounted on the carriage 51 to constitute the process unit PU. In addition, guide rails 52 extending in the Y direction are disposed, respectively facing both ends of the carriage 51 in the X direction (transporting direction Ds), and the carriage 51 is provided across the two guide rails 52. Accordingly, the carriage 51 allows the head units 6*a* to 6*f* and the UV radiators 37*a* to 37*e* to be movable in the Y direction by using the guide rails 52.

Moreover, in the process section 3, the UV radiator 38 for main curing is provided on the downstream side in the transporting direction Ds with respect to the head unit 6*f*. Thus, the clear ink, discharged by the head unit 6*f* and overlaid on the color image, receives ultraviolet rays from the UV radiator 38, to be subjected to the main curing. Note that the UV radiator 38 is not mounted on the carriage 51.

The sheet S onto which the color image is formed by the process section 3 is transported to the take-up section 4 by the rear drive roller 32. Other than the take-up shaft 40 around which the end of the sheet S is wound, the take-up section 4 has a driven roller 41, on which the back surface of the sheet S is wound, between the take-up shaft 40 and the rear drive roller 32. In a state in which the front surface of the sheet S faces outward, the take-up shaft 40 winds up and supports the end of the sheet S. That is, when the take-up shaft 40 rotates in the clockwise direction on the paper surface of FIG. 1, the sheet S transported from the rear drive roller 32 is wound up by the take-up shaft 40 via the driven roller 41. The sheet S is wound up by the take-up shaft 40 with a core tube (not shown) that is detachable from the take-up shaft 40 in between. Accordingly, when the sheet S wound up by the take-up shaft 40 is full, the sheet S can be removed together with the core tube.

Further, as illustrated in FIG. 2, each head unit 6 has a substantially rectangular head plate 62 extending in the Y direction. The head plate 62 is formed of metal, for example, and is a rigid member having high rigidity. A plurality of (five, in the embodiment) heads 60 linearly arrayed at a certain pitch in the Y direction are fastened by screws or the like on each side surface 62*a* of the head plate 62 in the X direction. In addition, the array of the heads 60 on the side surface 62*a* of the head plate 62 on the −X side and the array of the heads 60 on the side surface 62*a* of the head plate 62 on the +X side are displaced from each other in the Y direction by half of the pitch of the arrayed heads 60. That is, in plan view from the Z direction, ten heads 60 are aligned on two rows in a zigzag form in the Y direction. Moreover, a wiring member 63 made up of a flexible flat cable (FFC), flexible printed circuits (FPC), and the like are attached at the upper end (+Z side) of each of the heads 60.

On the upper side (+Z side) of the head plate 62, a manifold 61, which has a substantially rectangular shape and extends in the Y direction slightly more than the head plate 62, is disposed so as to be spaced from the head plate 62. The manifold 61 includes a plurality of flow paths therein and is configured to be able to supply ink from the ink supply section to each head 60.

Further, each head unit 6 has a substantially rectangular cover frame 66 formed to be hollow. The cover frame 66 is made of metal, for example, and holds on the inside thereof a circuit substrate 67 having the drive circuit (not shown) for driving the head 60. The circuit substrate 67 generates a control signal (electrical signal) for controlling discharge from the head 60 and outputs the generated signal to the head 60. In the embodiment, the cover frame 66 holds on the inside three circuit substrates 67 aligned in the Y direction. On each of the circuit substrates 67 mounted is a drive circuit including various devices such as a transistor, a capacitor, a coil, a resistor, and a memory, as well as metal wiring, and the like. On the side surface 66*a* of the cover frame 66 on the −X side, a fan 681 is provided so as to face the drive circuit mounted on each of the circuit substrates 67. The fan 681 generates air flow to cool (dissipate heat of) the circuit substrate 67 by the air flow. Further, a handle 682 provided on the +Y side end and a power cable 683 for supplying power to each of the circuit substrates 67 are attached to the cover frame 66.

Moreover, the cover frame 66 has a slit 661, which is disposed on the upper side (+Z side) of each of the heads 60, on the side wall 66*a* on the −X side. Five slits 661 are aligned in the Y direction on the side wall 66*a* of the cover frame 66. A fitting port 671 provided on the circuit substrate 67 is exposed from each of the slits 661, thereby allowing the wiring member 63 to be detachably engaged with the fitting port 671 via the slit 661. Accordingly, by fitting the fitting port 671 of the circuit substrate 67 to the wiring member 63 that extends from the head 60, a control signal can be transmitted from the circuit substrate 67 to the head 60 via the wiring member 63.

Figure 3B:
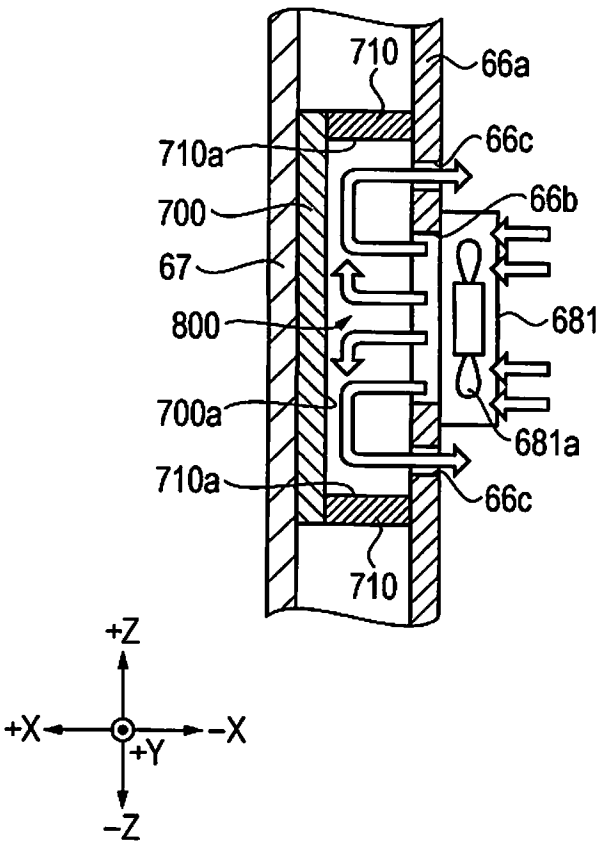
FIGS. 3A and 3B are detailed views of part of the head unit.
Figure 3A:
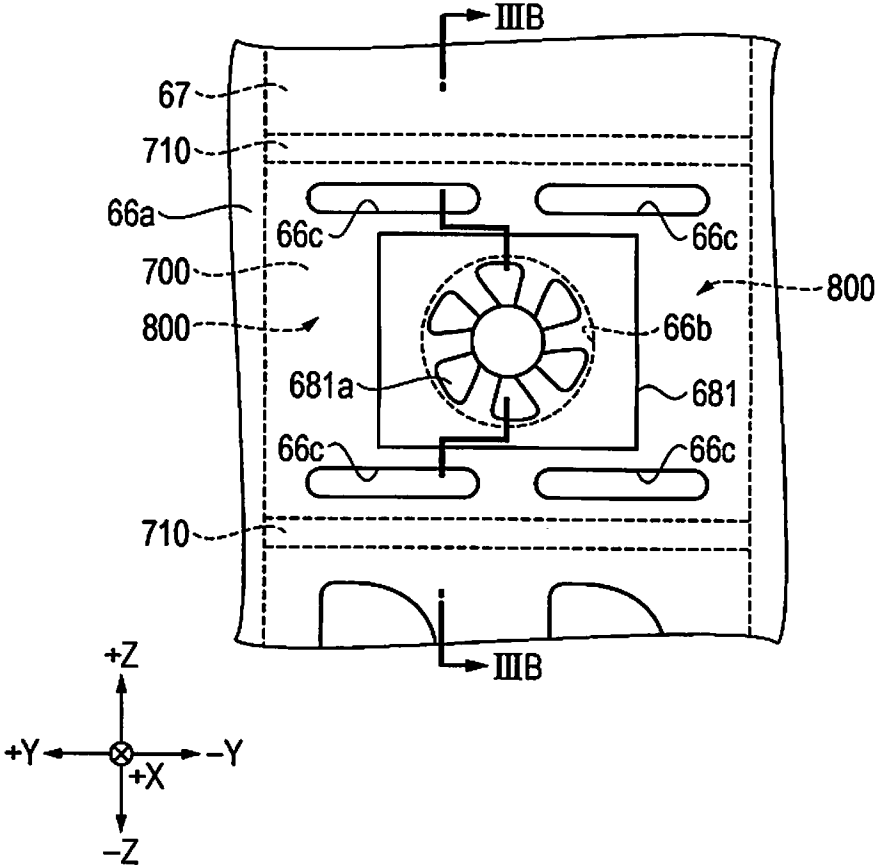

Next, an internal configuration of each head unit is described. FIGS. 3A and 3B are detailed views of part of the head unit. FIG. 3A is a plan view, and FIG. 3B is a sectional view taken along IIIB-IIIB in FIG. 3A.

As illustrated in FIGS. 3A and 3B, the fan 681 is disposed to face the drive circuit of the circuit substrates 67. Further, a heat sink 700 is disposed between the drive circuit of the circuit substrates 67 and the fan 681. The heat sink 700 is formed of a material such as aluminum or copper, for example, and can dissipate heat generated in the circuit substrate 67. The heat sink 700 of the embodiment is formed to have a tabular shape and in direct contact with one surface of the circuit substrate 67. The heat sink 700 may be configured so as to be in indirect contact with the circuit substrate 67. Further, a through hole (inlet 66*b*) is provided on the side wall 66*a* of the cover frame 66, and the fan 681 is installed so as to correspond to the inlet 66*b*. The fan 681 has a plurality of blade sections 681*a*, and by driving the fan 681, the blade sections 681*a* rotate to generate air flow. The air flow generated by the drive of the fan 681 is provided to the cover frame 66 via the inlet 66*b* and is directly blown against the heat sink 700, thereby efficiently dissipating heat generated in the circuit substrate 67. Further, the generated air flow is directly blown against the heat sink 700, and the air flow is not directly blown against the circuit substrate 67 in this configuration. That is, the air flow is not directly blown against the drive circuit mounted on the circuit substrate 67 in this configuration.

Moreover, the heat sink 700 is configured such that the air flow having changed its direction after blown against the heat sink 700 is not blown against the circuit substrate 67. In the embodiment, a wall section 710 is provided at part of the peripheral end of the heat sink 700. More specifically, the wall sections 710 are provided at the end of the heat sink 700 in the +Z direction and at the end of the heat sink 700 in the −Z direction. In addition, the wall sections 710 may be formed integrally with the heat sink 700 or formed integrally with the cover frame 66, or the heat sink 700 and the cover frame 66 may be provided as separate structures. Since the air flow generated by the drive of the fan 681 is blown against the wall section 710, the direction of the air flow can be changed. That is, the wall sections 710 can regulate the direction of the air flow. Further, the wall section 710 is disposed so as to be in contact with the surface of the heat sink 700 which is on the opposite side to the surface in contact with the circuit substrate 67 and so as to be in contact with one surface of the cover frame 66 which faces the heat sink 700. That is, the wall section 710 is configured such that the air flow supplied by the drive of the fan 681 does not flow toward the circuit substrate 67 (drive circuit) over the wall section 710 in the +Z direction or the −Z direction.

Further, a through hole (outlet 66*c*) is provided on the side wall 66*a* of the cover frame 66. The outlet 66*c* discharges air flow, which is supplied toward the heat sink 700 by the drive of the fan 681, from the cover frame 66 to the outside. As illustrated in FIG. 3A, in plan view, the outlet 66*c* is provided between the fan 681 and the wall section 710. In the embodiment, the outlet 66*c* is a long narrow through hole, and the outlets 66*c* are provided in the +Z direction and the −Z direction with respect to the fan 681.

Next, how the air flow generated by the drive of the fan 681 flows is described with reference to FIG. 3B. In addition, in FIG. 3B, directions of the air flow are schematically indicated by hollow arrows.

As illustrated in FIG. 3B, when the fan 681 is driven, the blade sections 681*a* rotate to take in air outside the fan 681 and generate air flow. The generated air flow flows from the inlet 66*b* toward the heat sink 700. Then, the air flow is blown against one surface 700*a* of the heat sink 700. Then, the air flow having been blown against the one surface 700*a* flows in the +Z direction and the −Z direction. The air flows having flowed in the +Z direction and the −Z direction are blown against one surface 710*a* of each of the wall sections 710. Thereby, the direction of the air flow is changed such that the air flow flows toward the cover frame 66 (−X direction). Then, the air flow having flowed toward the cover frame 66 is discharged from the outlet 66*c* to the outside of the cover frame 66. In addition, in the embodiment, the wall section 710 or the like is not provided in the +Y direction or the −Y direction of the heat sink 700, and a space 800 continuous in the +Y direction and the −Y direction of the heat sink 700 is formed. Hence, part of the air flow flows to another circuit substrate 67, which is adjacently disposed, via the space 800. This enables cooling of another circuit substrate 67 which is adjacently disposed.

According to the above embodiment, the following effect can be obtained.

The air flow generated by the drive of the fan 681 is supplied from the inlet 66*b* of the cover frame 66 and blown against the heat sink 700. Subsequently, the direction of the air flow is changed so that the air flows along the wall section 710, and the air flow is eventually discharged from the outlet 66*c*. Accordingly, the cooling efficiency of the circuit substrate 67 can be improved by the air flow blown against the heat sink 700. Further, the air flow is not directly blown against the drive circuit of the circuit substrate 67. The air flow moves along the wall section 710 and is discharged from the outlet 66*c*. Accordingly, even when mist, dust, or the like is contained in the generated air flow, adhesion of the mist, the dust, or the like to the drive circuit is reduced, and it is thus possible to prevent an electrical failure such as a short circuit and improve the reliability of the ink jet apparatus 1.

The invention is not limited to the embodiment described above, and various modifications, improvements, and the like can be added to the embodiment described above. Modification examples are described below.

MODIFICATION EXAMPLE 1

Figure 4B:
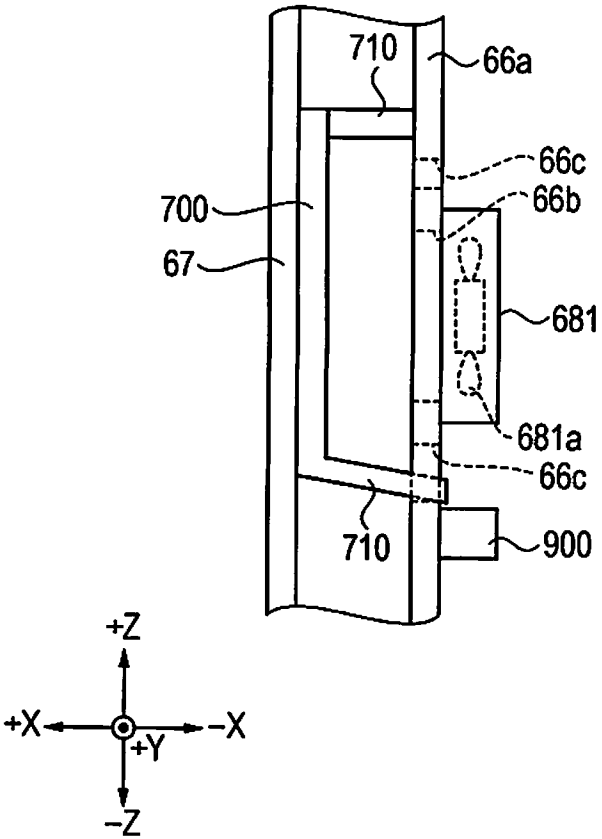
FIGS. 4A and 4B are schematic views illustrating a configuration of part of an ink jet apparatus according to Modification Example 1.
Figure 4A:
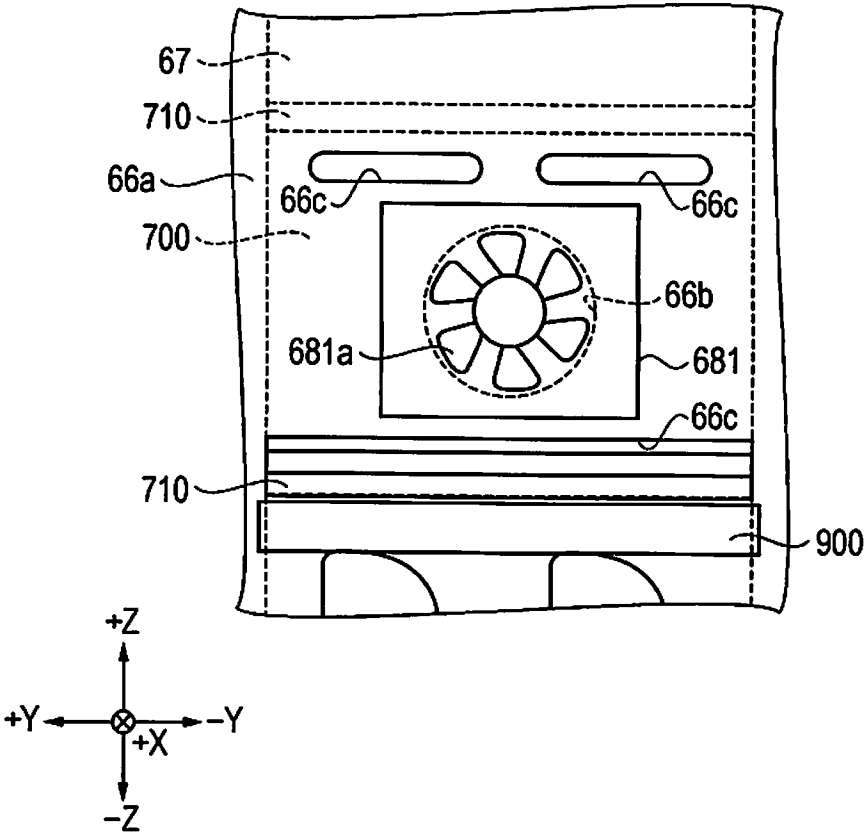

In the above embodiment, the fan 681 is driven and the generated air flow is made to flow toward the heat sink 700 and discharged from the outlet 66*c*. However, the invention may be configured to include a collection section for discharging from the outlet 66*c* and collecting mist which has adhered to the heat sink 700 and formed into droplets. FIGS. 4A and 4B are schematic views illustrating a configuration of part of an ink jet apparatus according to this modification example. FIG. 4A is a plan view, and FIG. 4B is a side view.

As illustrated in FIGS. 4A and 4B, a collection section 900 is provided in the −Z direction of the outlet 66*c* provided in the −Z direction with respect to the fan 681. The collection section 900 collects mist or the like which has been formed into droplet by adhering to the heat sink 700 and then discharged via the outlet 66*c*. The collection section 900 may be a container for storing the mist or an adsorbent formed of non-woven fabric or the like that adsorbs the mist. The wall section 710 provided in the −Z direction with respect to the fan 681 may be inclined against the gravity direction so that the mist which has been formed into droplets is easily discharged to the outlet 66*c*. Further, the wall section 710 may be formed integrally with the heat sink 700 so that the mist which has been formed into droplets is prevented from leaking. Such configuration enables efficient collection of the mist or the like which has adhered to the heat sink 700 and formed into droplets. It is thereby possible to prevent dripping of liquid and adhesion of contaminants to the cover frame 66.

MODIFICATION EXAMPLE 2

In the above embodiment, the outlets 66*c* are provided in the +Z direction and the −Z direction with respect to the fan 681, but the invention is not limited to this configuration. For example, the invention may be configured such that the outlet 66*c* is provided only in the +Z direction with respect to the fan 681. FIG. 5A is a schematic view (plan view) illustrating a configuration of part of an ink jet apparatus according to this modification example.

Figure 5B:
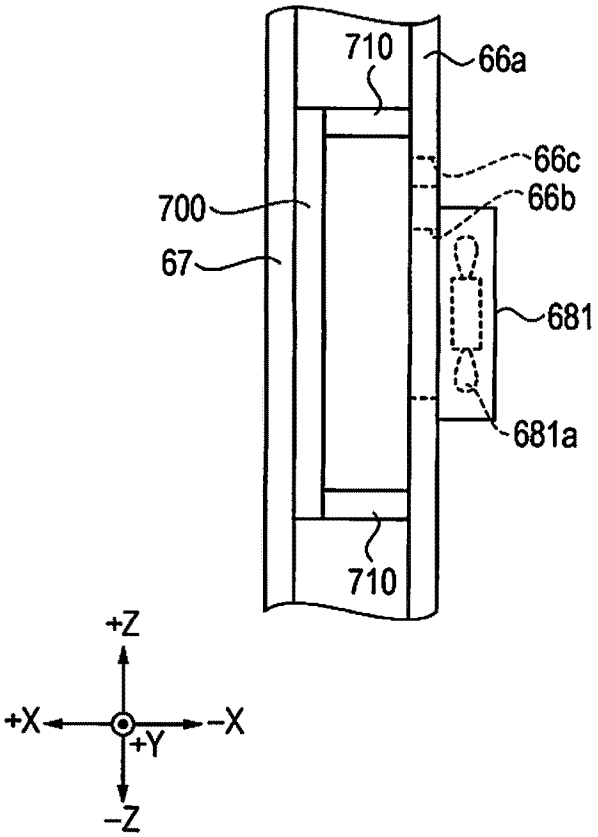
FIGS. 5A and 5B are schematic views illustrating a configuration of part of an ink jet apparatus according to Modification Example 2.
Figure 5A:
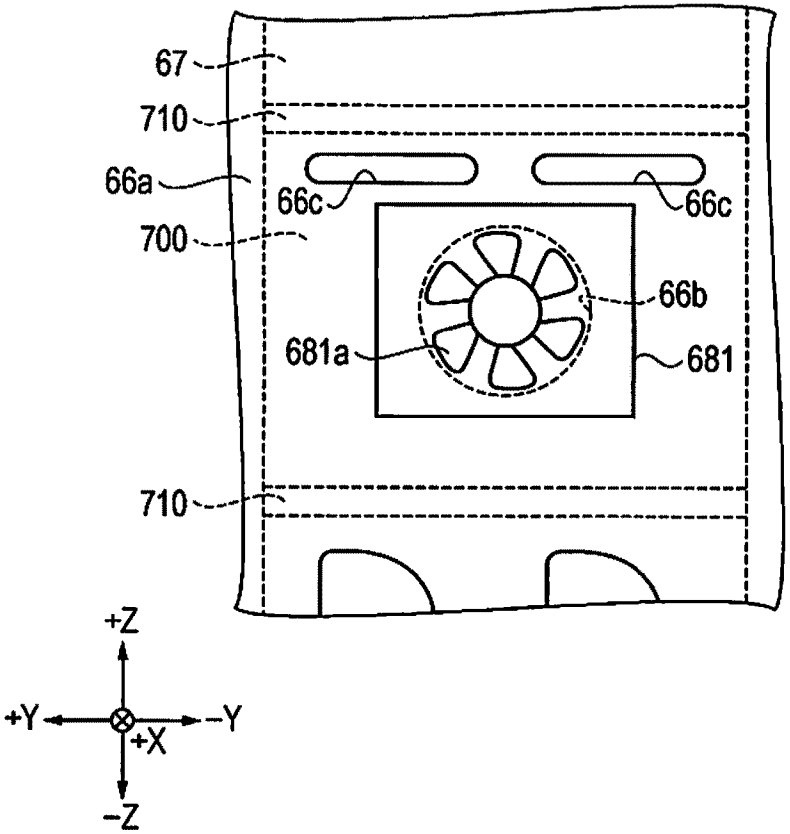

As illustrated in FIGS. 5A and 5B, the outlet 66*c* is provided on the side wall 66*a* of the cover frame 66 in the +Z direction with respect to the fan 681. That is, the outlet 66*c* is not provided in the −Z direction with respect to the fan 681. With such configuration, air flow supplied toward the heat sink 700 is discharged from the outlet 66*c* provided above the fan 681. That is, air flow containing mist is not easily flows toward the head 60 disposed below the fan 681, and hence it is possible to prevent the occurrence of a discharge failure without any influence of the air flow received at the time when the head 60 discharges droplets.

MODIFICATION EXAMPLE 3

Figure 6B:
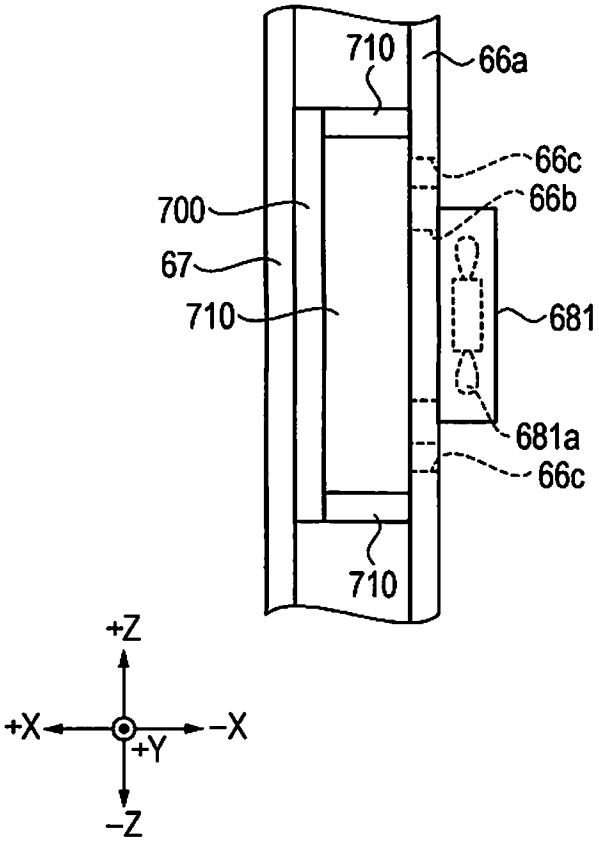
FIGS. 6A and 6B are schematic views illustrating a configuration of part of an ink jet apparatus according to Modification Example 3.
Figure 6A:
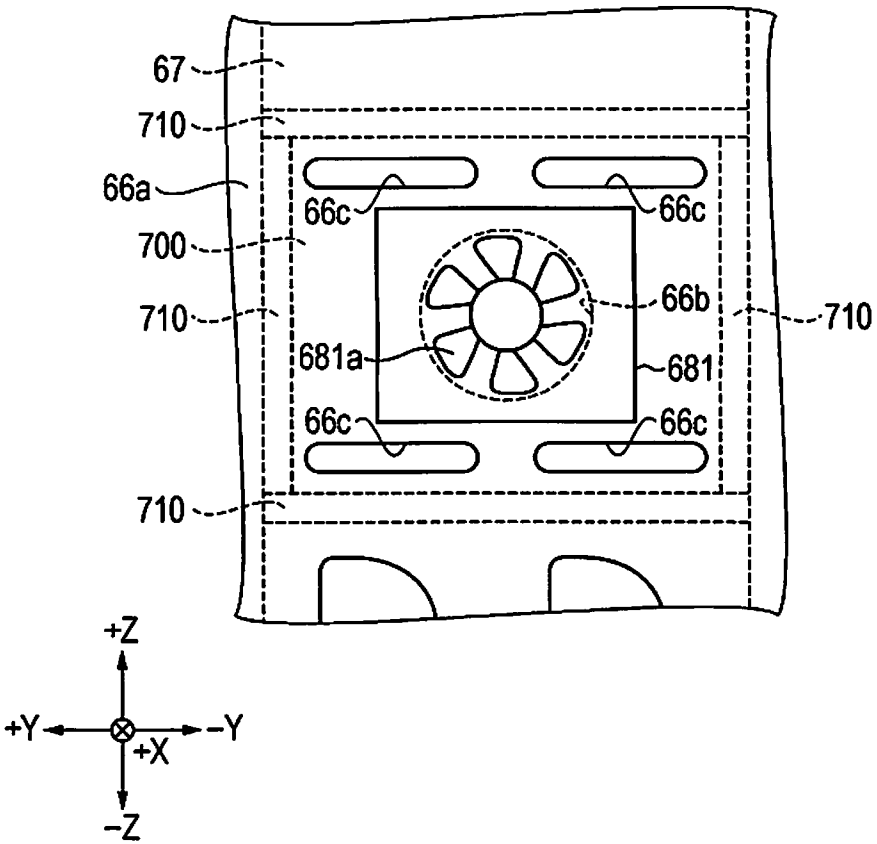

In the above embodiment, the wall sections 710 are provided at the end of the heat sink 700 in the +Z direction and at the end of the heat sink 700 in the −Z direction, but the invention is not limited to this configuration. For example, wall sections 710 may be provided at the end of the heat sink 700 in the +Y direction and at the end of the heat sink 700 in the −Y direction in addition to the wall sections 710 at the end of the heat sink 700 in the +Z direction and at the end of the heat sink 700 in the −Z direction. FIGS. 6A and 6B are schematic views illustrating a configuration of part of an ink jet apparatus according to this modification example. FIG. 6A is a plan view, and FIG. 6B is a side view.

As illustrated in FIGS. 6A and 6B, the wall sections 710 are provided at the end of the heat sink 700 in the +Z direction and at the end of the heat sink 700 in the −Z direction, and at the end of the heat sink 700 in the +Y direction and at the end of the heat sink 700 in the −Y direction. That is, the wall sections 710 are provided at all the periphery of the heat sink 700. With such configuration, air flow generated by the drive of the fan 681 is blown against the heat sink 700, and thereafter, the direction of the air flow is changed by the wall sections 710 provided at all the periphery of the heat sink 700, and the air flow is discharged from the outlet 66*c*. Hence, it is possible to reliably prevent mist contained in the air flow from adhering to the circuit substrate 67 (drive circuit).

MODIFICATION EXAMPLE 4

In the above embodiment, the wall section 710 is disposed so as to be in contact with the surface of the heat sink 700 which is on the opposite side to the surface in contact with the circuit substrate 67 and so as to be in contact with one surface of the cover frame 66 which faces the heat sink 700. However, the invention is not limited to this configuration. For example, the wall section 710 may be disposed so as to be in contact with the end surface of the heat sink 700 and with one surface of the cover frame 66 which faces the heat sink 700. With this configuration, a similar effect to the above effect can also be obtained.

MODIFICATION EXAMPLE 5

In the above embodiment, the heat sink 700 is provided on only one surface of the circuit substrate 67, but the invention is not limited to this configuration. For example, the heat sink 700 may be disposed on the other surface of the circuit substrate 67 in addition to the heat sink 700 on the one surface thereof. With this configuration, it is possible to further improve the cooling (heat dissipation) efficiency of the circuit substrate 67. Moreover, in this case, there may be disposed the fan 681 that makes air flow blown against the heat sink 700 disposed on the other surface of the circuit substrate 67. In this case, the wall section 710 and the outlet 66*c* that are similar to the above may be provided. With this configuration, a similar effect to the above effect can also be obtained.

MODIFICATION EXAMPLE 6

In the ink jet apparatus 1 of the above embodiment, five heads 60 are disposed, but the invention is not limited to this configuration. For example, the number of heads 60 may be four or less, or six or more, and can be changed as appropriate. With such configuration, a similar effect to the above can also be obtained.

MODIFICATION EXAMPLE 7

In the above embodiment, a description is given by taking UV ink as an example of the ink to be discharged from each head 60, but the invention is not limited thereto. Various inks other than the UV ink, such as a high-viscosity ink, can be applied. With this, a similar effect to the above can also be obtained.

MODIFICATION EXAMPLE 8

In the above embodiment, the sheet S is supported on the cylindrical drum (rotary drum 30), but the invention is not limited to this configuration. For example, the invention may be configured such that the sheet S is supported on the flat surface. Also in this configuration, a similar effect to the above effect can be obtained.

An ink jet apparatus according to one example includes a head, a circuit substrate, a heat sink, and a fan. The head discharges liquid. The circuit substrate has a drive circuit for driving the head. Part of the heat sink is directly or indirectly in contact with the circuit substrate, and the heat sink can dissipate heat generated in the circuit substrate. The fan generates air flow capable of cooling the heat sink. The heat sink is configured such that the air flow is not directly blown against the drive circuit and such that the air flow having changed a direction after blown against the heat sink is not blown against the drive circuit.

According to this configuration, since the circuit substrate having the drive circuit is in contact with the heat sink, heat generated in the drive circuit can be efficiently dissipated from the circuit substrate via the heat sink. Moreover, air flow generated by the drive of the fan is applied to the heat sink to cool the heat sink, and hence the cooling effect of the circuit substrate can further be improved. Herein, the air flow supplied toward the heat sink by the drive of the fan may contain mist which is generated when droplets are discharged from the head. When the air flow containing mist is supplied toward the heat sink, there is a possibility that the mist may form droplets and adhere to the drive circuit, thereby causing the occurrence of an electrical failure such as a short circuit. According to this configuration, air flow generated by the drive of the fan is blown against the heat sink and is not directly blown against the drive circuit. This reduces the adhesion of mist to the drive circuit. Further, the air flow blown against the heat sink and changed its direction, flows but is not blown against the drive circuit. That is, the direction of the air flow generated by the drive of the fan is regulated so that the air flow is not blown against the drive circuit. This can improve the cooling (heat dissipation) efficiency of the circuit substrate and reduce the adhesion of mist to the drive circuit, thereby preventing an electrical failure such as a short circuit.

In the ink jet apparatus according to the above application example, the fan is disposed to face the drive circuit and the heat sink is disposed between the drive circuit and the fan.

According to this configuration, air flow generated by the drive of the fan easily is blown against the heat sink, thereby allowing efficient cooling (heat dissipation) of the drive circuit. Further, placement of the heat sink can make the air flow generated by the drive of the fan, hardly blown against the drive circuit.

What is claimed is:

1. An ink jet apparatus, comprising:

a head configured to discharge liquid;

a circuit substrate that has a drive circuit that is configured to drive the head;

a cover frame supporting the circuit substrate inside of the cover frame, the cover frame having a through hole;

a heat sink which has a part that is in direct or indirect contact with the circuit substrate and is configured to dissipate heat generated in the circuit substrate, the heat sink being disposed inside of the cover frame;

a fan configured to generate air flow to cool the heat sink, the fan being arranged such that the fan and the heat sink face to each other via the through hole in a facing direction; and a wall section disposed inside of the cover frame and disposed between the fan and the heat sink in the facing direction, such that the air flow is not directly blown against the drive circuit and such that the air flow having changed a direction after blown against the heat sink is not blown against the drive circuit.

2. The ink jet apparatus according to claim 1, wherein the fan is disposed to face the drive circuit and the heat sink is disposed between the drive circuit and the fan.

3. The ink jet apparatus according to claim 1, wherein the through hole is disposed between the heat sink and the fan.

4. The ink jet apparatus according to claim 1, wherein the cover frame and the heat sink are provided as separate members, and the through hole is disposed at the cover frame.

5. The ink jet apparatus according to claim 1, wherein the wall section has one end portion that contacts the heat sink and an opposite end portion that contacts the cover frame, and the opposite end portion is opposite the one end portion.

6. The ink jet apparatus according to claim 5, wherein the cover frame includes a side wall that has an outer surface and an inner surface that faces in an opposite direction of the outer surface, the opposite end portion of the wall section contacts the inner surface of the side wall of the cover frame, and the fan is disposed on the outer surface of the side wall of the cover frame.

7. The ink jet apparatus according to claim 1, further comprising a collection section configured to collect mist adhered to the heat sink.

8. The ink jet apparatus according to claim 7, wherein the collection section is attached to the cover frame such that the collection section does not overlap the heat sink as viewed in a direction in which the fan and the heat sink face to each other.

* * * * *